US007549951B2

(12) United States Patent
Scrivens

(10) Patent No.: US 7,549,951 B2
(45) Date of Patent: Jun. 23, 2009

(54) HAND-WEIGHT CRADLE APPARATUS

(75) Inventor: Thomas Scrivens, Canterbury, NH (US)

(73) Assignee: Thomas R. Scrivens, Canterbury, NH (US)

( * ) Notice: Subject to any disclaimer, the term of this patent is extended or adjusted under 35 U.S.C. 154(b) by 660 days.

(21) Appl. No.: 11/273,957

(22) Filed: Nov. 15, 2005

(65) Prior Publication Data

US 2006/0116255 A1 Jun. 1, 2006

Related U.S. Application Data

(60) Provisional application No. 60/631,611, filed on Nov. 29, 2004.

(51) Int. Cl.
*A63B 21/00* (2006.01)
*A63B 21/072* (2006.01)

(52) U.S. Cl. ..... 482/108; 482/904

(58) Field of Classification Search ..... 482/104–106, 482/108, 904; 280/304.1
See application file for complete search history.

(56) References Cited

U.S. PATENT DOCUMENTS

| | | | | | |
|---|---|---|---|---|---|
| 3,370,850 | A * | 2/1968 | Moore | 482/105 |
| 4,213,605 | A * | 7/1980 | McPeak | 482/105 |
| 4,531,728 | A * | 7/1985 | Wright | 482/106 |
| 4,722,524 | A * | 2/1988 | Waszkelewicz | 482/106 |
| 4,865,314 | A * | 9/1989 | Carter, Jr. | 482/106 |
| 5,033,740 | A * | 7/1991 | Schwartz et al. | 482/105 |
| 5,058,886 | A * | 10/1991 | Jackson | 482/106 |
| 5,217,421 | A * | 6/1993 | Chrysler | 482/104 |
| 5,433,686 | A * | 7/1995 | Marsh | 482/104 |
| 5,536,228 | A | 7/1996 | Tanner, Jr. | |
| 5,588,663 | A | 12/1996 | Rundle et al. | |
| 5,651,758 | A * | 7/1997 | Cervantes | 482/93 |
| 5,762,593 | A | 6/1998 | Whiteley | |
| 5,807,185 | A | 9/1998 | Raubuck et al. | |
| 5,897,468 | A * | 4/1999 | Lumpkin | 482/106 |
| 6,123,651 | A * | 9/2000 | Ellenburg | 482/104 |
| 6,371,893 | B1 * | 4/2002 | Redden | 482/105 |
| 6,676,575 | B1 * | 1/2004 | Mayo | 482/104 |
| 6,709,370 | B1 | 3/2004 | Evans | |
| 6,715,728 | B2 * | 4/2004 | Nielsen | 248/339 |
| 7,025,712 | B2 * | 4/2006 | Parrilla | 482/104 |
| 2008/0070759 | A1 * | 3/2008 | Chaulk | 482/104 |

FOREIGN PATENT DOCUMENTS

DE 3546203 A1 * 7/1987

* cited by examiner

*Primary Examiner*—LoAn H. Thanh
*Assistant Examiner*—Victor K Hwang
(74) *Attorney, Agent, or Firm*—S. Michael Bender, BME, J.D.

(57) ABSTRACT

A hand-weight cradle apparatus includes a first cradle/base module which includes a base portion, a cradle portion, and base-to-cradle connection means connected between the base portion and the cradle portion. A second cradle/base module includes a base portion and a cradle portion, and base-to-cradle connection means connected between the base portion and the cradle portion, and a first bridge member is connected between the first cradle/base module and the second cradle/base module. A third cradle/base module can be provided which includes a base portion, a cradle portion, and base-to-cradle connection means connected between the base portion and the cradle portion. Also, a second bridge member is connected between the second cradle/base module and the third cradle/base module. The hand-weight cradle apparatus of the invention is especially useful for a person who is sitting on the seat of a wheelchair.

7 Claims, 3 Drawing Sheets

FIG 1
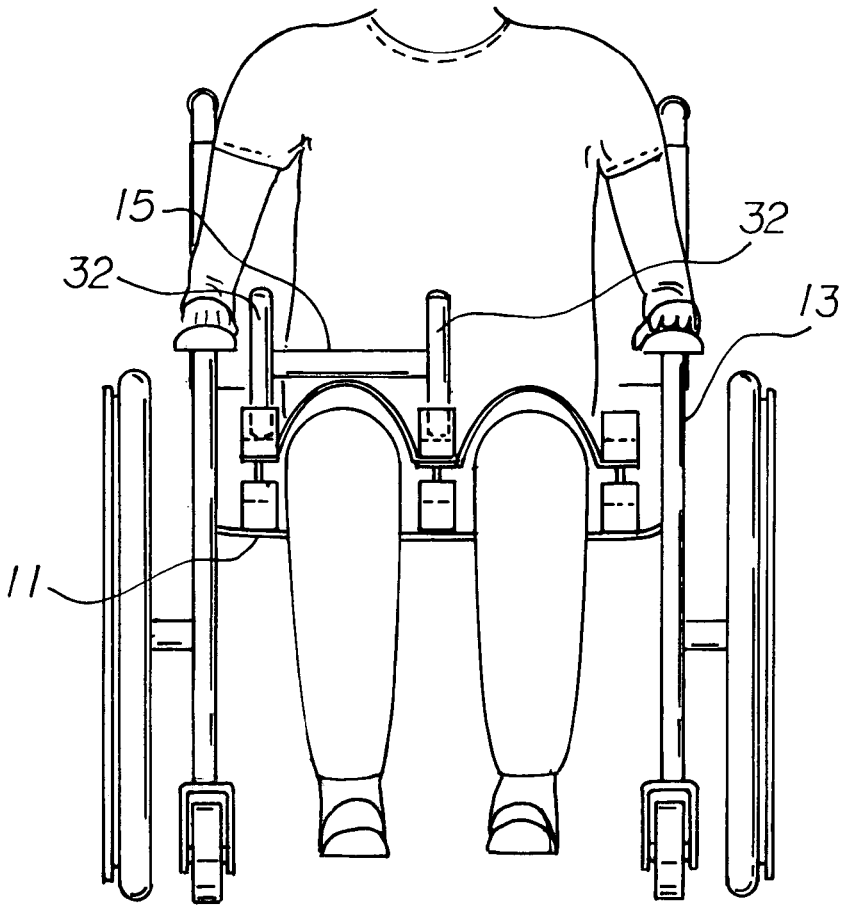
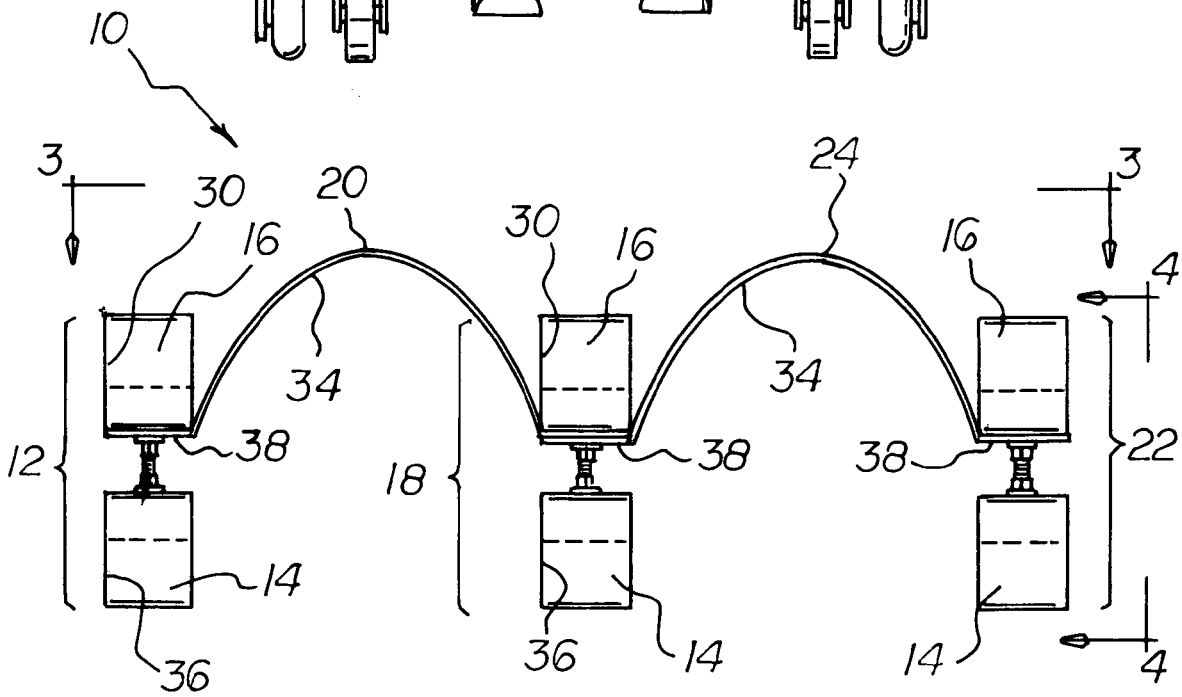
FIG 2

FIG 3
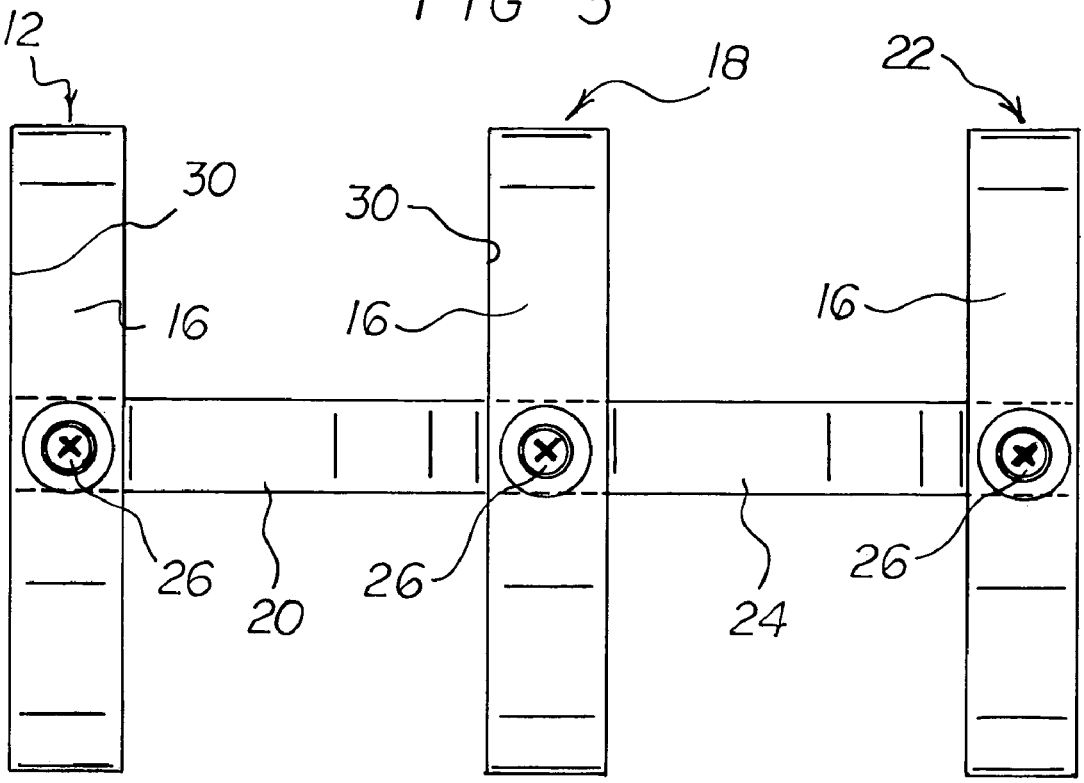
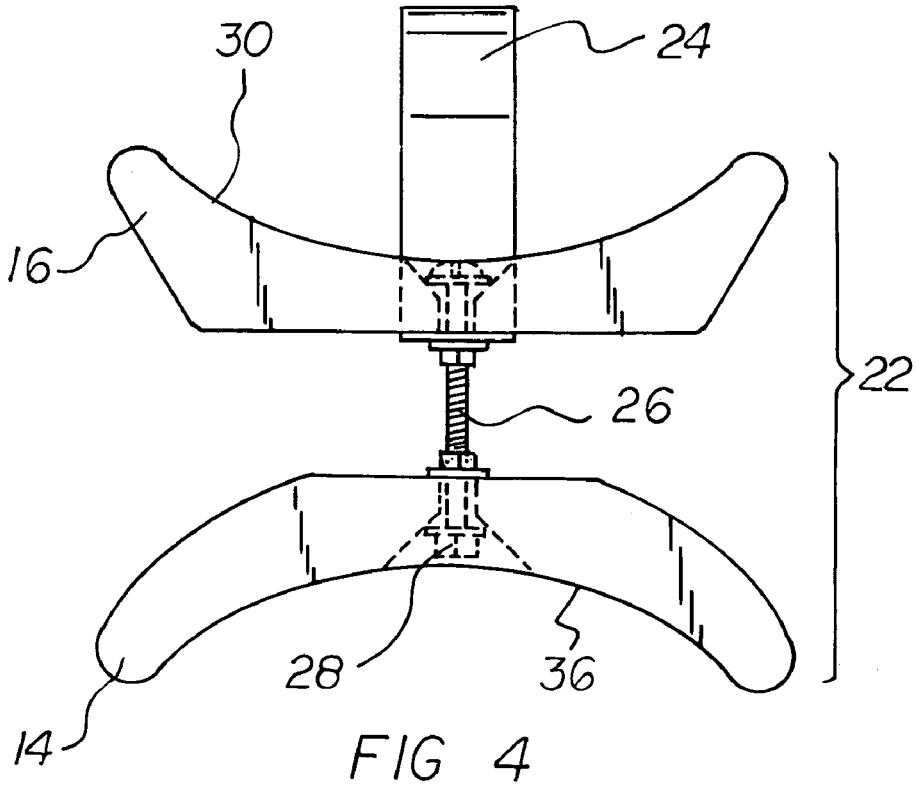
FIG 4

FIG 5
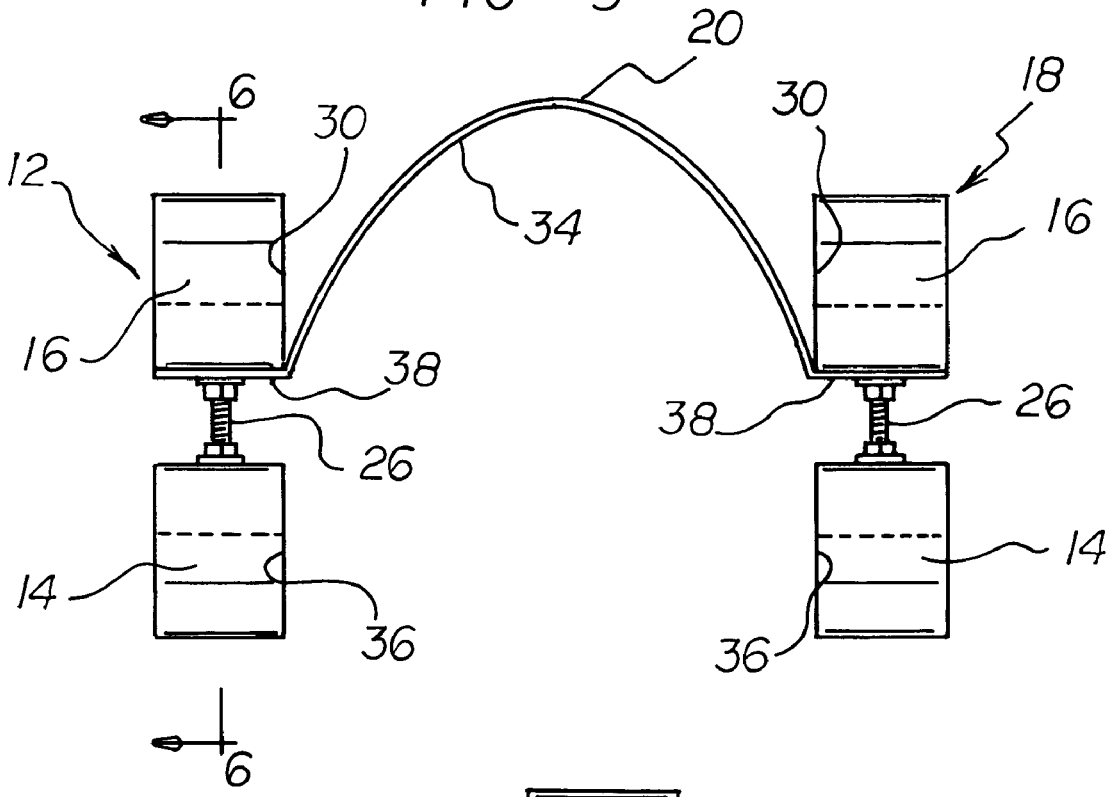
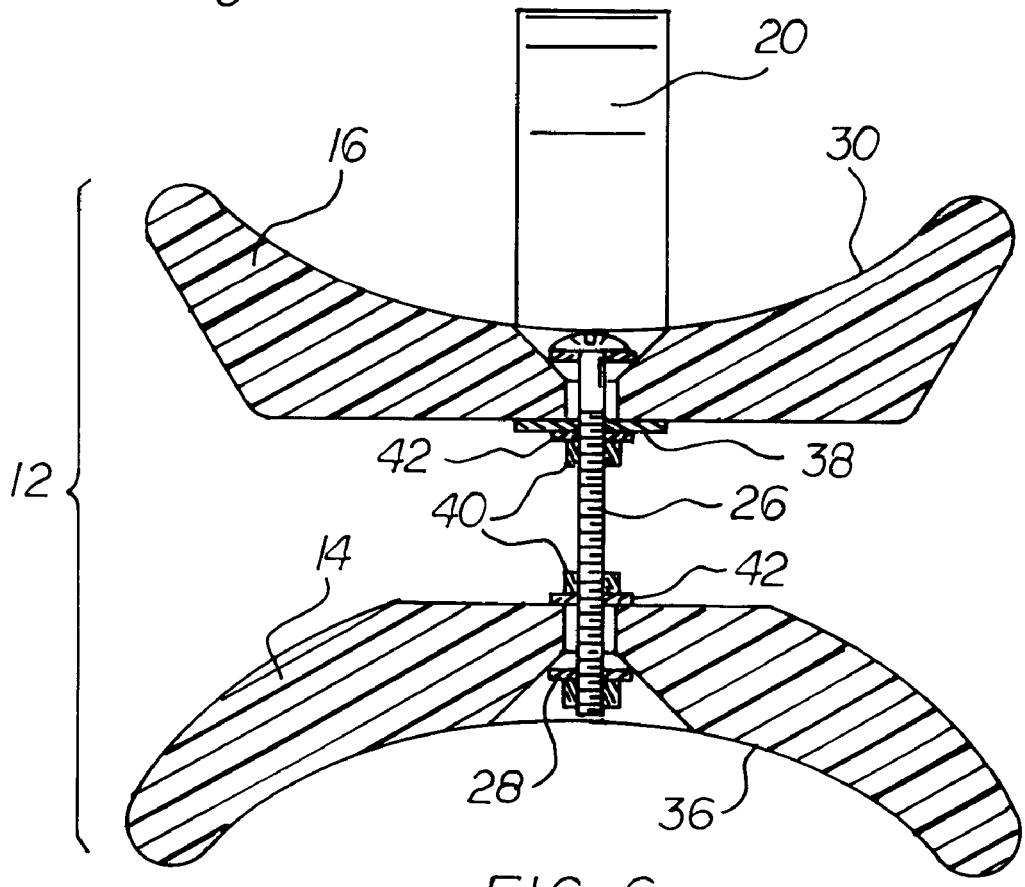
FIG 6

HAND-WEIGHT CRADLE APPARATUS

CROSS-REFERENCE TO RELATED APPLICATION

This application claims priority based upon my copending Provisional Application Ser. No. 60/631,611; filed Nov. 29, 2004.

BACKGROUND OF THE INVENTION

1. Field of the Invention

The present invention relates generally to wheelchairs and, more particularly, to devices especially adapted for permitting a person seated in a wheelchair to carry out exercise.

2. Description of the Prior Art

Exercising devices are well known in the prior art for permitting a person seated in a wheelchair to carry out some form of exercise. In this respect, throughout the years, a number of innovations have been developed relating to devices for allowing a person seated in a wheelchair to carry out exercise, and the following U.S. patents are representative of some of those innovations: U.S. Pat. Nos. 5,536,228, 5,762,593, and 5,807,185.

More specifically, U.S. Pat. No. 5,536,228 discloses an exercise device for a wheelchair bound person, wherein the person pulls on elastic ropes to cause the wheelchair to roll back and forth along a platform. This device permits the person in the wheelchair to exercise one's arms. However, this device requires the complexities of elastic ropes, supports for the elastic ropes, and a platform on which the wheelchair can roll back and forth. To avoid such complexities, it would be desirable if an exercising device for a person seated in a wheelchair were provided which does not require elastic ropes, supports for the elastic ropes, and a platform on which the wheelchair can roll back and forth.

U.S. Pat. No. 5,762,593 discloses an exercise device for a person seated in a wheelchair. The exercise device includes handle portions that are mounted on a fixed framework next to which the wheelchair is positioned. When the wheelchair is moved away from the fixed framework, the person in the wheelchair is no longer able to use the exercise devices. Rather than require the wheelchair to be positioned adjacent to an extraneous fixed framework so that the person seated in the wheelchair can carry out manual exercise, it would be desirable if an exercising device for a person seated in a wheelchair were provided which allowed the seated person to carry out the exercise while seated in the wheelchair independent of a fixed extraneous framework. In this way, the person can carry out the exercise wherever the wheelchair is positioned.

U.S. Pat. No. 5,807,185 discloses another device in which a wheelchair is positioned next to a fixed framework so that the seated person can use exercise equipment attached to the fixed framework. When the wheelchair is moved away from the fixed framework, the person seated in the wheelchair cannot carry out the exercise.

U.S. Pat. No. 5,588,663 may be of interest for its disclosure of a wheelchair tray accessory.

U.S. Pat. No. 6,709,370 may also be of interest for its disclosure of a weight bench associated with a supports for dumbbells.

Still other features would be desirable in a hand-weight cradle apparatus. More specifically, it would be desirable if an exercising device for a person seated in a wheelchair were provided which allowed the seated person to use hand-held dumbbells. Such a device would allow a person seated in a wheelchair to roll over to an assemblage of dumbbells, to select desired dumbbells, and to roll away from the assemblage with the selected dumbbells. Such a device would allow a person seated in a wheelchair to stop using the dumbbells, such as when taking a rest break, without having the weight of the dumbbells bearing down on the person's legs.

Thus, while the foregoing body of prior art indicates it to be well known to use exercising devices by a person seated in a wheelchair, the prior art described above does not teach or suggest a hand-weight cradle apparatus, for use by a person seated in a wheelchair, which has the following combination of desirable features: (1) does not require elastic ropes, supports for the elastic ropes, and a platform on which the wheelchair can roll back and forth; (2) allows the seated person to carry out the exercise while seated in the wheelchair independent of a fixed extraneous framework; (3) allows the seated person to use hand-held dumbbells; (4) allows a person seated in a wheelchair to roll over to an assemblage of dumbbells, to select desired dumbbells, and to roll away from the assemblage with the selected dumbbells; and (5) allows a person seated in a wheelchair to stop using the dumbbells, such as when taking a rest break, without having the weight of the dumbbells bearing down on the person's legs.

The foregoing desired characteristics are provided by the unique hand-weight cradle apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a hand-weight cradle apparatus which includes a first cradle/base module which includes a base portion, a cradle portion, and base-to-cradle connection means connected between the base portion and the cradle portion. A second cradle/base module includes a base portion and a cradle portion, and base-to-cradle connection means connected between the base portion and the cradle portion, and a first bridge member is connected between the first cradle/base module and the second cradle/base module.

A third cradle/base module can be provided which includes a base portion, a cradle portion, and base-to-cradle connection means connected between the base portion and the cradle portion. Also, a second bridge member is connected between the second cradle/base module and the third cradle/base module.

The hand-weight cradle apparatus of the invention is especially useful for a person who is sitting on the seat of a wheelchair.

The first bridge member and the second bridge member include flat ends that are secured to respective cradle portions with the base-to-cradle connection means.

The base-to-cradle connection means can include a connection bolt extending between the base portion and the cradle portion, and a connection nut is affixed to the connection bolt. In addition, adjustment nuts and washers can be provided for adjusting the distance between the base portion and the cradle portion and for securing the base portion and the cradle portion to the base-to-cradle connection means.

Preferably, the cradle portion includes a concave well portion. Each of the first bridge member and the second bridge member includes a bottom concave portion adapted to straddle a person's thigh. In addition, the base portion includes a concave well portion.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hand-weight cradle apparatus which has all of the advantages of the prior art and none of the disadvantages.

It is another object of the present invention to provide a new and improved hand-weight cradle apparatus which may be easily and efficiently manufactured and marketed.

It is a further object of the present invention to provide a new and improved hand-weight cradle apparatus which is of durable and reliable construction.

An even further object of the present invention is to provide a new and improved hand-weight cradle apparatus which is susceptible of a low cost of manufacture with regard to both materials and labor, and which accordingly is then susceptible of low prices of sale to the consuming public, thereby making such hand-weight cradle apparatus available to the buying public.

Still yet a further object of the present invention is to provide a new and improved hand-weight cradle apparatus which does not require elastic ropes, supports for the elastic ropes, and a platform on which the wheelchair can roll back and forth.

Still another object of the present invention is to provide a new and improved hand-weight cradle apparatus that allows the seated person to carry out the exercise while seated in the wheelchair independent of a fixed extraneous framework.

Yet another object of the present invention is to provide a new and improved hand-weight cradle apparatus which allows the seated person to use hand-held dumbbells.

Even another object of the present invention is to provide a new and improved hand-weight cradle apparatus that allows a person seated in a wheelchair to roll over to an assemblage of dumbbells, to select desired dumbbells, and to roll away from the assemblage with the selected dumbbells.

Still a further object of the present invention is to provide a new and improved hand-weight cradle apparatus which allows a person seated in a wheelchair to stop using the dumbbells, such as when taking a rest break, without having the weight of the dumbbells bearing down on the person's legs.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a front view showing a first embodiment of the hand-weight cradle apparatus of the invention positioned on the seat of a wheelchair and being used to support a hand weight.

FIG. 2 is an enlarged front view of the embodiment of the hand-weight cradle apparatus shown in FIG. 1 removed from the seat of the wheelchair.

FIG. 3 is a top view of the embodiment of the hand-weight cradle apparatus of FIG. 2 taken along line 3-3 thereof.

FIG. 4 is an end view of the embodiment of the invention shown in FIG. 2 taken along line 4-4 thereof.

FIG. 5 is a front view of a second embodiment of the invention.

FIG. 6 is an enlarged cross-sectional view of the embodiment of the invention shown in FIG. 5, taken along line 6-6 thereof.

DESCRIPTION OF THE PREFERRED EMBODIMENT

With reference to the drawings, a new and improved hand-weight cradle apparatus embodying the principles and concepts of the present invention will be described.

Turning to FIGS. 1-4, there is shown a first embodiment of the hand-weight cradle apparatus of the invention generally designated by reference numeral 10. In each of the figures, reference numerals are shown that correspond to like reference numerals that designate like elements shown in other figures.

In the first embodiment, hand-weight cradle apparatus 10 includes a first cradle/base module 12 which includes a base portion 14, a cradle portion 16, and base-to-cradle connection means connected between the base portion 14 and the cradle portion 16. A second cradle/base module 18 includes a base portion 14 and a cradle portion 16, and base-to-cradle connection means connected between the base portion 14 and the cradle portion 16, and a first bridge member 20 is connected between the first cradle/base module 12 and the second cradle/base module 18.

With an embodiment of the invention shown in FIGS. 5 and 6, only the first bridge member 20 is present between the first cradle/base module 12 and the second cradle/base module 18.

With the embodiment of the invention shown in FIGS. 1-4, a third cradle/base module 22 is provided which includes a base portion 14, a cradle portion 16, and base-to-cradle connection means connected between the base portion 14 and the cradle portion 16. Also, a second bridge member 24 is connected between the second cradle/base module 18 and the third cradle/base module 22.

The first bridge member 20 and the second bridge member 24 include flat ends 38 that are secured to respective cradle portions 16 with the base-to-cradle connection means. The first bridge member 20 and the second bridge member 24 can be made from 1 inch by 1/16 inch steel with foam padding. The flat ends 38 can include adjustment slots from the center to ¼ inch from the edges of the flat ends 38.

The base-to-cradle connection means can include a connection bolt 26 extending between the base portion 14 and the cradle portion 16, and a connection nut 28 is affixed to the connection bolt 26. In addition, adjustment nuts 40 and washers 42 can be provided for adjusting the distance between the base portion 14 and the cradle portion 16 and for securing the base portion 14 and the cradle portion 16 to the base-to-cradle connection means.

Preferably, the cradle portion 16 includes a concave well portion 30. The concave well portion 30 is adapted to receive a complementary convex-shaped weight member 32, such as from a hand dumbbell weight 15. The cradle portions 16 and the base portions 14 can be adapted from existing dumbbell racks which are made from hard plastic. Each of the first bridge member 20 and the second bridge member 24 includes a bottom concave portion 34 adapted to straddle a person's thigh. In addition, the base portion 14 includes a concave well portion 36. The concave well portion 36 is adapted to engage a seat cushion of a seat.

The hand-weight cradle apparatus 10 of the invention is especially useful for a person who is sitting on the seat 11 (includes seat cushion) of a wheelchair 13. More specifically, the hand-weight cradle apparatus 10 is positioned so that the first bridge member 20 straddles one of the person's thighs, and the second bridge member 24 straddles the other of the person's thighs. In addition, the respective base portions 14 of the first cradle/base module 12, the second cradle/base module 18, and the third cradle/base module 22 rest on the seat 11 (includes seat cushion). It is important to note that the thighs of the person do not support the weight of the hand-weight cradle apparatus 10. Instead, the seat 11 and seat cushion support the weight of the hand-weight cradle apparatus 10.

As shown in FIG. 1, a hand weight 15 is supported by the hand-weight cradle apparatus 10 of the invention. More specifically, each convex-shaped weight member 32 is supported in a respective concave well portion 30 of a respective cradle portion 16. The weight of the hand weight 15 and the hand-weight cradle apparatus 10 is supported by the seat 11 and seat cushion of the wheelchair 13, not by the first bridge member 20, the second bridge member 24, and the thighs of the person. More specifically, the thighs of the person and the first bridge member 20 and the second bridge member 24 are used to position or locate the cradle portions 16 for receipt of the hand weight 15. The first bridge member 20 and the second bridge member 24 also protect the users thighs from the weights.

It will be appreciated that a single hand weight 15 may be supported in either the left concave well portion 30 or the right concave well portion 30 depending upon which hand is being exercised. In this regard, it is within the contemplation of the present invention to make the transverse dimension of the second cradle/base module 18 sufficiently large (or wide) enough to receive two hand weights 15 simultaneously in a juxtaposed manner.

The embodiment of the invention shown in FIGS. 5 and 6 has only the first cradle/base module 12 and the second cradle/base module 18 and can be used with one of the user's thighs to position the hand-weight cradle apparatus 10 of the invention.

When any embodiment of the hand-weight cradle apparatus 10 of the invention is used with a person in a wheelchair 13, the person can let a hand weight 15 rest on the hand-weight cradle apparatus 10 and have one's hand free for controlling the wheelchair 13 without the hand weight 15 rolling around uncontrollably. The use of a hand-weight cradle apparatus 10 allows a user to progress to heavier and heavier weights as required without fear of injury from the heaviness of the weights resting on the person's body.

Although particular attention has been paid to persons seated in a wheelchair 13, the hand-weight cradle apparatus 10 can be used by any person seated in any type of seat 11. In this respect, the hand-weight cradle apparatus 10 can be used by elderly and disabled persons.

The components of the hand-weight cradle apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved hand-weight cradle apparatus that is low in cost, relatively simple in design and operation, and which may advantageously be used without requiring elastic ropes, supports for the elastic ropes, and a platform on which the wheelchair can roll back and forth. With the invention, a hand-weight cradle apparatus is provided which allows the seated person to carry out the exercise while seated in the wheelchair independent of a fixed extraneous framework. With the invention, a hand-weight cradle apparatus is provided which allows the seated person to use hand-held dumbbells. With the invention, a hand-weight cradle apparatus is provided which allows a person seated in a wheelchair to roll over to an assemblage of dumbbells, to select desired dumbbells, and to roll away from the assemblage with the selected dumbbells. With the invention, a hand-weight cradle apparatus is provided which allows a person seated in a wheelchair to stop using the dumbbells, such as when taking a rest break, without having the weight of the dumbbells bearing down on the person's legs.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A portable hand-weight cradle apparatus for use by a person seated on a chair, comprising:

a first cradle/base module which includes a base portion, a cradle portion including a concave well portion, and base-to-cradle connection means connected between said base portion and said cradle portion, a second cradle/base module which includes a base portion and a cradle portion including a concave well portion, and base-to-cradle connection means connected between said base portion and said cradle portion, and a first bridge member connected between said first cradle/base module and said second cradle/base module, said first bridge member being characterized by a bottom concave portion sized and configured to transversely straddle the thigh of a person seated in the chair without bearing weight on the person's thigh, said first bridge member including a pair of opposed flat ends that are secured to the first and second cradle portions of said first and second cradle/base modules via said respective base-to-cradle connection means, wherein said base portion of said first cradle/base module is adapted to engage the chair proximal to one side of the person's thigh with said concave well portion of said cradle portion of said first cradle/base module facing concave upward and wherein said base portion, of said second cradle/base module is adapted to engage the chair proximal to the other side of the person's thigh with said concave well portion of said cradle portion of said second cradle/base module facing concave upward such that a dumbbell having first and second opposed weight members may be supported on the chair with the first and second weight members of the dumbbell being cradled in the concave well portions of said first and second cradle portions of said first and second cradle/base modules, respectively, when the person is seated on the chair.

2. The apparatus of claim 1, further including:

a third cradle/base module which includes a base portion, a cradle portion including a concave well portion, and base-to-cradle connection means connected between said base portion and said cradle portion, and a second bridge member connected between said second cradle/base module and said third cradle/base module.

3. The apparatus of claim 2 wherein said second bridge member includes flat ends that are secured to respective cradle portions with said base-to-cradle connection means.

4. The apparatus of claim 2 wherein said second bridge member includes a bottom concave portion adapted to straddle a person's thigh.

5. The apparatus of claim 1 wherein each said base-to-cradle connection means includes a connection bolt extending between said base portion and said cradle portion and a connection nut affixed to said connection bolt.

6. The apparatus of claim 1, further including:

adjustment nuts and washers for adjusting space between each said base portion and respective said cradle portion and for securing said base portion and said cradle portion to a respective said base-to-cradle connection means.

7. The apparatus of claim 1 wherein each said base portion includes a concave well portion.

* * * * *